United States Patent [19]

Tyson

[11] 4,444,313

[45] Apr. 24, 1984

[54] STORAGE, SHIPPING, DISPLAY AND DISPENSING PACKAGE OF ROLL MATERIAL

[76] Inventor: Travis C. Tyson, 106 Diane Dr., Dalton, Ga. 30720

[21] Appl. No.: 316,442

[22] Filed: Oct. 29, 1981

[51] Int. Cl.[3] ..... B65D 85/66; B65D 85/671

[52] U.S. Cl. ..... 206/397; 206/407; 206/408; 206/414

[58] Field of Search ..... 206/389, 391, 397, 398, 206/402, 54, 407, 413, 414, 416

[56] References Cited

U.S. PATENT DOCUMENTS

| | | | |
|---|---|---|---|
| 1,348,857 | 8/1920 | Ford | 206/389 |
| 2,181,555 | 11/1939 | Warp | 206/389 |
| 2,713,938 | 7/1955 | Snyder | 206/389 |
| 2,864,493 | 12/1958 | Holcombe | 206/407 |
| 3,231,080 | 1/1966 | Williams | 206/389 |
| 3,763,619 | 10/1973 | Stone | 206/389 |
| 3,865,326 | 2/1975 | Beaudoin | 206/389 |
| 3,942,638 | 3/1976 | Stone | 206/389 |
| 3,944,157 | 3/1976 | Kessler | 206/389 |
| 3,981,400 | 9/1976 | Quintana | 206/407 |
| 4,042,107 | 8/1977 | Kendig | 206/386 |
| 4,208,790 | 6/1980 | Eglinton | 206/389 |
| 4,231,475 | 11/1980 | Kessler | 206/389 |
| 4,235,390 | 11/1980 | Kessler | 206/389 |

*Primary Examiner*—Joseph Man-Fu Moy

[57] ABSTRACT

A storage, shipping, display and dispensing package includes providing maximum protection for roll material during shipment by allowing the material to be shipped with its backing up, while permitting dispensing and display of the material face side up without rewinding. End pieces held adjacent the roll material by core inserts prevent coning while supporting the roll for rotation. The core inserts are barbed to preclude accidental withdrawal and have low friction bearing surfaces which ride in the end pieces and rotatably support the roll within the container. An access opening in the front face of the container permits the carpet to be dispensed and selectively positioned slots and tabs allow like containers to be stacked one above the other and locked together.

13 Claims, 11 Drawing Figures

STORAGE, SHIPPING, DISPLAY AND DISPENSING PACKAGE OF ROLL MATERIAL

BACKGROUND OF THE INVENTION

1. Field of the Invention

This invention relates to containers. More particularly, this invention relates to a combined storage, shipping, display and dispensing container for roll material. While the invention is adapted for use with a variety of roll materials, it has particular application in the carpet industry.

2. Description of the Prior Art

Various forms of goods come in rolls such as, for example, paper, textiles, broadloom carpets, outdoor carpet, grass carpet, resilient floor covering and the like. Many such roll products and in particular such products as grass carpet made of polypropylene face yarns have a slippery surface which makes the roll prone to coning. Coning or telescoping is the undesired condition wherein internal layers of a roll product shift axially such that the edges of each layer of the roll no longer terminate in a common plane. The layers close to the core of the material tend to shift axially outward further than the layers of the outer periphery of the roll. In addition to making handling and storage of the roll product awkward, coning substantially increases the risk of damage to the product, particularly at the ends and increases the number of returned orders.

To this end, customarily carpet rolls of a particular style are ordered in quantities of several rolls and shipped to a retail outlet under a single order. Should any one of the rolls cone and be refused, the entire order is returned to the manufacturer notwithstanding the fact that there is nothing wrong with one or more rolls.

Another problem with coning is that it may prevent a roll product such as grass carpet or outdoor carpet from being displayed on conventional display racks. Such display racks normally include side supports, spaced slightly greater than the width of the roll being displayed. The rack generally comprises two end frames which may be in the form of A-frames between which several rolls of carpet are rotatably supported. The rolls may be supported one above the other. Each roll is usually supported by passing a roll bar through its hollow central core over which the product is wound. Opposite ends of the bar are seated on suitable supporting hooks and allow the product to be readily unwound. Since the spacing of the side supports or support frames is only slightly greater than the width of the carpet roll, any lateral shifting or coning of the carpet layers will either prevent the roll from being placed in the rack or cause binding of the edges of the carpet against the side supports to make unwinding of the carpet roll very difficult.

Another problem with handling of roll products is damage to the pile face. Finished textile products are wound upon manufacture into rolls from which rolls of suitable lengths may be cut for use. These rolls are wrapped for storage and shipping. Frequently, the material is wound with the backside of the material up to protect the pile face from damage during storage or shipment. However, once the roll has been shipped to the retail outlet, the carpet must be rewound with the pile face outward for display purposes. It will be appreciated that this rewinding step is time consuming and expensive.

It is therefore a primary object of the present invention to provide a combined storage, shipping, display and dispensing package of roll materials which avoids the aforementioned disadvantages and which is relatively simple in construction, lightweight, and inexpensive to manufacture.

A further object of the present invention is to provide a combined shipping and display package which prevents coning of a roll product.

Yet another object of the present invention is to provide a combined shipping and display container which enables a carpet roll product to be shipped with the pile face inward yet avoids the necessity of rewinding the carpet roll at the retail outlet prior to display and sale.

Yet another object of the present invention is to provide a combined shipping and display container for a roll product provided with end pieces which protect the ends of the roll and which prevent coning as well as facilitate the unwinding of the product.

A still further object of the present invention is to provide a combined shipping and display container wherein the amount of material remaining on the roll within the container may be easily determined while the container is closed thereby providing maximum protection of the contents.

SUMMARY OF THE INVENTION

These and other objects of the present invention will become apparent as the description proceeds and are accomplished by a combined storage, shipping, display and dispensing container for a roll product which permits the product to be readily unwound for display and sale while at all times being protected. The novel container of the present invention comprises a first end, a second end, a center portion therebetween formed by four sides, one of which includes an access opening through which the roll material may be withdrawn without the container being otherwise opened. Each end includes a central access opening to which the stake of a forklift may be inserted for handling of the container. At least one end has its access opening connected to an integral "peep" slot which enables a retailer to determine the amount of product remaining within the container. Before the roll product is placed within the container, there is provided at each end thereof an end piece having a central opening extending therethrough and a core insert. Each core insert includes an axially extending cylindrical portion and a flange. The inner surface of the flange is positioned to abut the outer surface of the adjacent end piece while the axially extending portion passes through the central opening end piece and within the hollow core of the roll product.

The axially extending portion of each core insert includes a high friction roll gripping portion at one end and a relatively low friction bearing portion located between the flange and the roll gripping portion so that each core insert may be rotatably supported by the associated end piece. To this end, the bearing portion is positioned within the internal surface of the end piece that defines the opening therein. The roll gripping portion extends into the hollow supporting core or if no core, into the central opening of the roll product to secure the core insert to the roll. In this manner, the core insert can rotate when the product is unwound from the coil.

The roll gripping portion of the core inserts may include a plurality of radially outwardly extending barbs which grip the carpet roll or its supporting core.

The barbs are slanted away from the center such that the core inserts may be readily inserted into the core of the carpet roll, but will resist removal from the core.

BRIEF DESCRIPTION OF THE DRAWINGS

These and other features of the present invention and the attendant advantages will be readily apparent to those having ordinary skill in the art and the invention will be more easily understood from the following detailed description of the preferred embodiments of the present invention taken in conjunction with the accompanying drawings wherein like reference characters represent like parts throughout the several views.

DETAILED DESCRIPTION OF THE PREFERRED EMBODIMENTS

Figure 1:
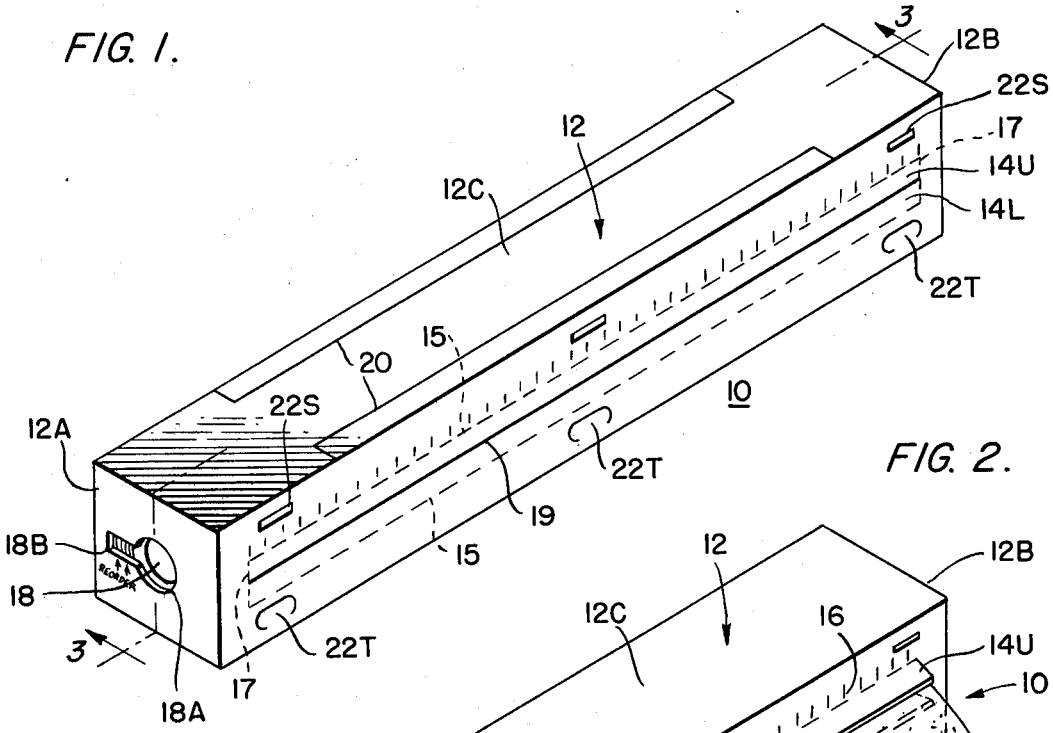
FIG. 1 shows a perspective view of the present invention.

Referring now to FIG. 1, there is illustrated a perspective view of the package 10 of the present invention containing a roll product (not visible in FIG. 1) and ready for shipping or storage. The package includes a container 12 shown in its assembled position. It will be readily apparent to those skilled in the art that the container is formed by folding a precut carton blank and joining various flap members together in a manner well known in the art with the rolled carpet and end pieces being inserted before the last flaps are sealed down. The container 12 is in the form of a rectangular box and preferably is made of cardboard. Container 12 includes a first end 12A and a second end 12B connected by a center section 12C made up of four side members. One side of the container includes an access opening 14 formed by an upper dispensing flap 14U and lower dispensing flap 14L. To this end, horizontal score lines 15 extend substantially the entire length of the container and are joined at opposite ends by vertical score lines 17 which are in turn joined by a central score line 19 all of which are provided in the carton blank. During storage and shipping of the container and contents, the dispensing flaps 14U and 14L remain sealed. The upper edge of dispensing flap 14U has provided therealong suitable indicia 16 which may be used to measure the carpet as it is dispensed. To this end, after the carpet is withdrawn, the carpet is folded over itself, left to right with the left edge 24L (see FIG. 2 momentarily) paralleling the indicia 16.

The top and bottom sides of the container may include score lines 20 which enable portions of the sides to be folded out to gain access to the interior for removal of shipping strengtheners (not shown in FIG. 1) which are inserted to give added strength to the container for shipment and prevent excessive shifting of the material within the container during shipment. These shipping strengtheners are removed at the retail outlet when the container is set up for display of the contents.

A series of slots 22S may be scored out along the upper portion of the front side of the box 12 as shown. Likewise, a series of butterfly tabs 22T may be disposed along the lower portion of the same side of box 12. The slots 22S and butterfly tabs 22T may be used for interlocking and stabilizing several stacked containers.

A key shaped opening 18A is disposed at end 12A of container 12. It should be understood that the other end 12B of the container 12 is constructed in an identical fashion so that only the construction of one end need be discussed. Initially, the opening 18A may simply be scored in the flap of the blank forming end 12A and a key hole shaped piece may be removed during assembly of the carton blank. Although the score lines corresponding to flaps 14U and 14L and score lines 20 are preferably kept intact until the container has been shipped to the retail location for display and dispensing purposes, the score lines corresponding to hole 18A would preferably be punched out prior to shipment of the package to facilitate handling. In particular, opening 18 is comprised of two portions, a circular opening portion 18A centered on the end 12A and a slot 18B extending radially outward therefrom. The circular portion 18A may be used to allow insertion of a stake of a forklift truck in order to move the package, whereas the slot portion 18B may be used to allow gripping of the container by hand to manually move the package. However, the slot may also serve as a "peep" hole in which case suitable indicia may be provided corresponding to the number of feet of material left on the roll. This marking provides a ready reference for the merchant as to the need for reordering materials.

It should be readily appreciated, because of the flat unobstructed side surfaces of the container, the container provides a readily efficient and convenient storage arrangement with the containers being stored in stacked relationship one atop the other ready for shipment. Likewise, these containers are conveniently stored at retail locations until ready to be placed on the floor for display.

Figure 2:
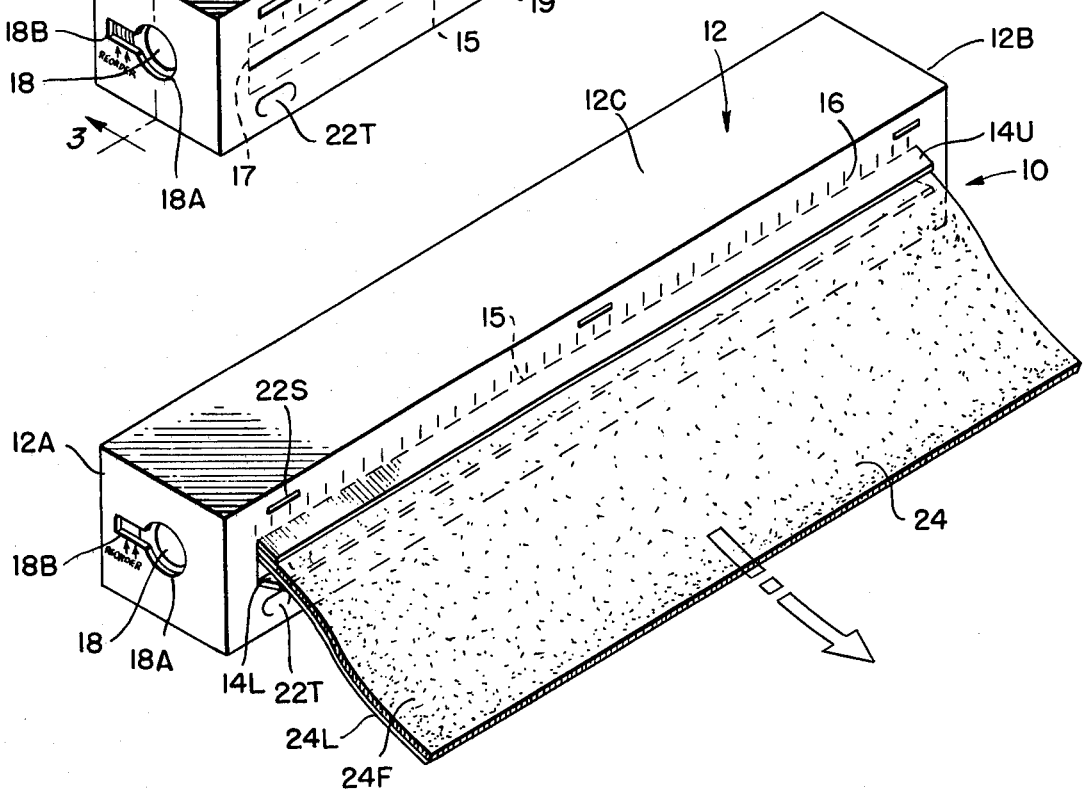
FIG. 2 shows a perspective view of the present invention with the access opening of the container opened in a portion of rolled contents, which in the illustrated embodiment is grass carpet, withdrawn for display purposes.

Turning now to FIG. 2, the present invention is shown in the form useful for dispensing and display purposes. In particular, the center score line 19 has been slit and the upper dispensing flap 14U hinged upward along its score line 15. A lower dispensing flap 14L is hinged downward along its bottom in a fashion similar to that of the upper dispensing flap. Alternatively, the lower dispensing flap 14U may be removed or not provided in the first instance and the container 12 may be constructed with only a single dispensing flap to provide an access opening. Flooring material shown as carpet 24 may be unwound from the roll within the closed right-angle parallelepiped box or container 12. As used herein, "flooring material" includes textile carpet, synthetic carpet, and vinyl or similar material commonly used for flooring purposes.

Figure 3:
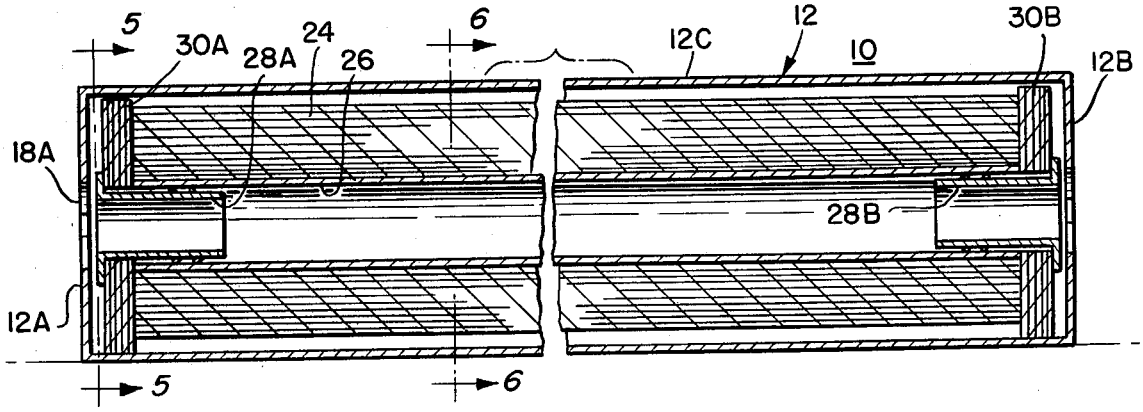
FIG. 3 shows a cross-section view taken along the lines 3—3 of FIG. 1.

FIG. 3 shows a cross-sectional view taken along lines 3—3 of FIG. 1. The contents of container 12 will be seen to include carpet 24 disposed in a roll around a hollow core 26. Within the container and adjacent to ends 12A and 12B, respectively, are first and second end pieces 30A and 30B which may be constructed of corrugated cardboard. Core inserts 28A and 28B are disposed partially within the core at opposite ends.

Figure 7:
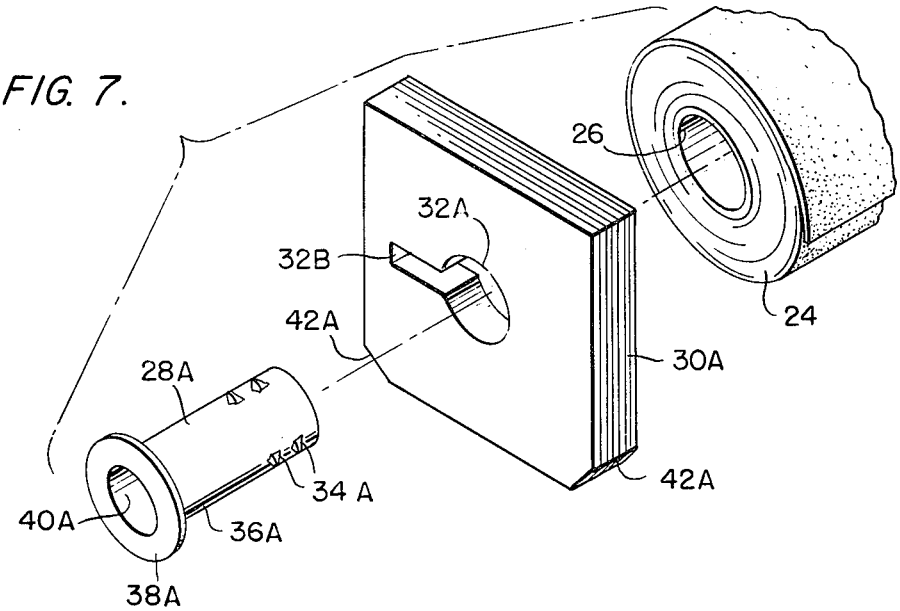
FIG. 7 shows an exploded view of a core insert, an end piece and an associated carpet roll according to the present invention.

Turning now to FIG. 7, and continuing to view FIG. 3, the relationship between the core inserts 28A and 28B and the respectively associated end pieces 30A and 30B will presently be described. FIG. 7 shows an exploded view of core insert 28A, end piece 30A and carpet roll 24, it being understood that the construction at the other end is identical. As indicated in FIG. 7, core insert 28A extends through hole 32A into the core 26 of the carpet roll 24. Core insert 28A includes a flange 38A and a hollow axially extending cylindrical part having relatively low friction bearing portion 36A and a relatively high friction gripping portion having barbs 34A. Barbs 34A extend radially outward from the axis of core insert 28A. Additionally, in order to facilitate insertion of core insert 28A, the barbs 34A are slanted outwardly away from the center of container 12.

The assembly of the present invention is relatively straightforward. The carpet 24 is rolled around the core 26 in a manner well known in the art. First end piece 30A is placed adjacent the end of carpet 24 and core insert 28A is inserted through hole 32A and force fit into core 26 such that barbs 34A will secure the core insert to the core 26. The second end piece 30B and corresponding second core insert 28B may be likewise assembled at the other end of the carpet roll. The end piece 30A may include chamfered portions 42A to facilitate insertion of endpiece 30A in box 12. This assembly may be then be placed in the container 12 such that the openings 18A, 40A of the insert, 32A and the core 26 are all coaxial and the container is closed off. Because the end of carpet roll 24 is closely adjacent the end pieces 30A and 30B, the aforenoted coning problem will be avoided during storage, shipping and display.

Preferably, the end pieces 30A and 30B are made of corrugated cardboard, whereas the core inserts 28A and 28B are made of metal or plastic. It will be readily appreciated that whatever material core inserts 28A and 28B are made of, the barbs 34A and the corresponding barbs on the other core insert should be sufficiently strong to securely grip to the inside surface of core 26. To this end, core 26 may be made of cardboard, or other materials adapted to be pierced by the barbs.

Figure 6:
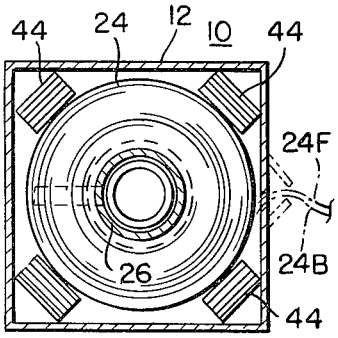
FIG. 6 shows a cross-section view taken along lines 6—6 of FIG. 3.

Continuing to view FIGS. 3 and 7, and also considering FIG. 6, which shows a cross-sectional view taken along lines 6—6 of FIG. 3, the dispensing operation of the present invention will be readily appreciated. Specifically, once flaps 14U and 14L have been opened, carpet 24 may be readily unwound from its core 26. Core inserts 28A and 28B will rotate with the carpet core 26 by virtue of the barbs 34A gripping the core 26. End pieces 30A and 30B will rotatably support the respective corresponding core inserts 28A and 28B with their bearing portions 36A and 36B bearing against the cylindrical surface portion of holes 32A, 32B in endpieces 30A, 30B. The planar inner surface of flange portions 38A will bear against end piece 30A. Additionally, as best shown in FIG. 6, the carpet may be rolled with its backing 24B facing outward, thus providing maximum protection to the pile face 24F during shipping. Further, there is no need for rewinding of the carpet since upon unwinding it is dispensed with the pile face 24F of the carpet facing up.

Figure 4:
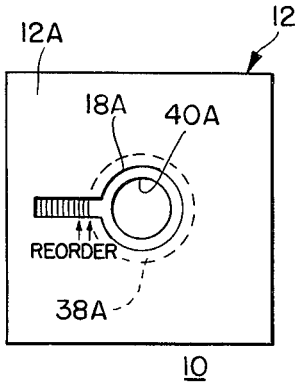
FIG. 4 shows an end view of the present invention.

FIG. 4 is an end view of the container 10 of the present invention. As shown, the circular portion of keyhole shaped hole 18A is in registry with and coaxial to the circular center hole 40A of core insert 28A. Accordingly, tools such as the stake of a forklift may be inserted in that portion in order to conveniently move the package. In addition, the slot portion 18B of hole 18A will be in registry with the slot portion 32B of hole 32A of end piece 30A, thereby functioning as a view slot allowing one to determine the amount of carpet that remains in the package without the necessity of opening the box 12. Further, the slot portions 18B and 32B may serve as a convenient handle for manual lifting of the package 10 to move it about, particularly at the retail outlet or showroom where heavy equipment may not be available.

Figure 5:
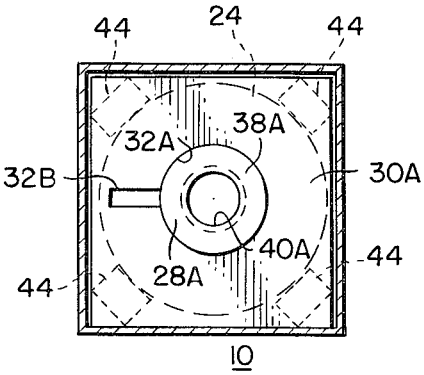
FIG. 5 shows a cross-section view taken along lines 5—5 of FIG. 3.

The purpose and use of score lines 20 shown in FIG. 1 will be discussed with reference to FIG. 5. FIG. 5 shows a cross-section view along lines 5—5 of FIG. 3. Rectangular pieces of corrugated cardboard shipping strengtheners 44 disposed along each of the axially extending edges of container 12 are utilized to prevent shifting of the roll 24 during shipping of the package. The shipping strengtheners 44 may be removed by way of score lines 20 (shown in FIG. 1 only) and the top side of the container. Corresponding score lines (not shown) on the bottom of container 12 enable the lower strengtheners to be removed. Upon removal of the strengtheners, roll 24 is free to rotate with core inserts 28A and 28B supporting the carpet 24 on end pieces 30A and 30B. It should be noted that score lines 20 extend only partially across the length of the container and entirely within slots 22S and tabs 22T so as not to interfere with the function of the tab connections.

Figure 8:
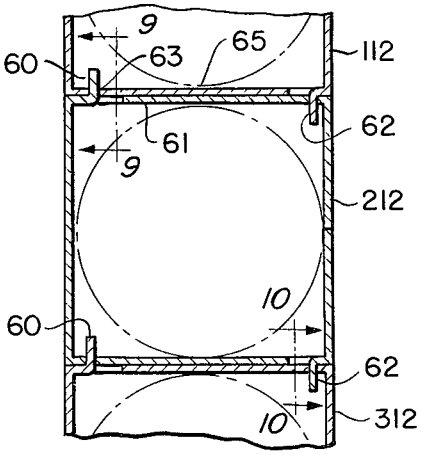
FIG. 8 shows in cross-section a fragmentary end view of three stacked containers according to the present invention.
Figure 9:
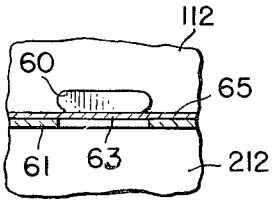
FIG. 9 shows a cross-section view taken along lines 9—9 of FIG. 8.
Figure 10:
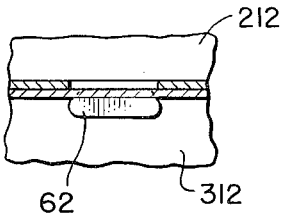
FIG. 10 shows a cross-section view taken along lines 10—10 of FIG. 8.
Figure 11:
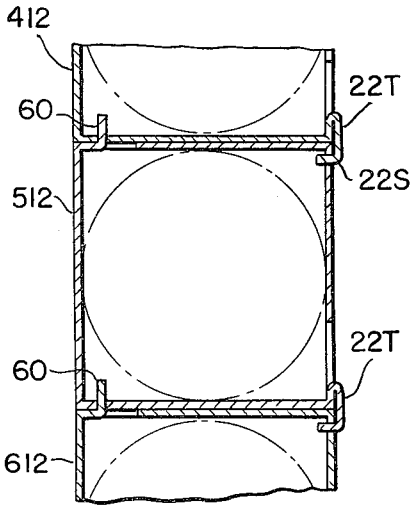
FIG. 11 shows a cross-section end view of several stacked containers illustrating an alternate form of locking tab in accordance with the present invention.

FIG. 8 shows three boxes, 112, 212 and 312, stacked one atop the other in accordance with the present invention and connected to each other by tabs for added stability. To this end, butterfly tabs 60 provided in top side 61 of container 212 extend upward from the container into a mating slot 63 punched out of the lower side 65 of container 112 immediately above container 212 as is best shown in FIG. 9 (line 9—9 of FIG. 8). Similarly, butterfly tab 62 may extend from the upper container 112 to the container immediately below it as is best shown in FIG. 10, which is the view taken along lines 10—10 of FIG. 8. Alternatively, the containers may be stacked as shown in FIG. 11 wherein boxes 612, 512 and 412 are stacked one atop the other. This configuration includes the use of butterfly tabs 22T at the upper front side of the container which tabs lock into the corresponding slots 22S located in the lower front side of the container situated below. As shown in FIG. 11, the bottom side of each box may include fold-up tabs 60 for locking in slots in the bottom side of the adjacent container above. On the other hand, both sides (front and back) of the container may include fold-down locking tabs 22T and locking slots 22S as shown on the right side of FIG. 11. Alternatively, tabs 22T may be disposed near the top of a container to cooperate with slots disposed near the bottom of an adjacent stacked container. It should also be readily apparent that various combinations of the arrangements shown in FIGS. 8–11 may be employed.

It is preferred, however, that tabs and corresponding slots be situated axially along the box as is shown in FIG. 1 for the slots 22S and the corresponding fold-down butterfly tabs 22T. The various locking tab constructions which have been described are especially useful in avoiding the danger of having a top box on a stack pulled off as a roll is unwound. It will be appreciated that, because of the construction of the present invention, several containers may be stacked one on top of another with easy access to all of the boxes for dispensing textile materials from them. Thus, a merchant can readily stack several styles or colors of carpet.

Although the preferred embodiment of the present invention includes end pieces 30A and 30B separate from the container 12 itself, the invention in its broadest aspects contemplates the use of the container or box 12 end flaps as the end pieces. This construction would have the flanges 38A and 38B outside of the container 12 and, therefore, the flanges would not prevent axially movement of the core insert away from the center 12C. However, this alternate construction would be slightly simpler than the preferred embodiment having end pieces 30A and 30B which are not integral with container 12.

Although the present invention has been described with reference to particular materials and structures, it is to be understood that these details are for illustrative purposes only. Various modifications and adaptations will be readily apparent to those of ordinary skill in the art. Accordingly, the scope of the present invention should be determined by reference to the appended claims.

What is claimed is:

1. A package for storage, shipping, display, and dispensing of a roll of flooring material comprising:

a container having a first end, a second end, and a center therebetween;

a roll of flooring material disposed within said container and extending axially along a roll axis between said first end and said second end;

a first end piece having a hole extending therethrough and disposed at said first end of said container;

a first core insert having a flange and an axially extending part including a relatively high friction roll gripping portion and a relatively low friction bearing portion in between said flange and said roll gripping portion;

said first core insert being rotatably supported by said first end piece with said axially extending part extending from said flange towards said center through said hole of said first end piece and with said bearing portion bearing against said hole of said first end piece; and wherein said roll gripping portion secures said first core insert to said roll of flooring material such that said first core insert rotates when flooring material is unwound from said roll.

2. The package of claim 2 wherein said container is a closed right-angle parallelepiped box.

3. The package of claim 1 wherein said axially extending part of said first core insert is cylindrical and hollow, said flange of said first core insert is annular with a center hole in registry with the hollow inside of said axially extending part of said first core insert, and said first end of said box includes a hole in registry with said center hole of said flange.

4. The package of claim 1 a second end piece having a hole extending therethrough and disposed at said second end of said container;

a second core insert having a flange and an axially extending part including a relatively high friction roll gripping portion and a relatively low friction bearing portion in between said flange and said roll gripping portion, said second core insert being rotatably supported by said second end piece with its axially extending part extending from its flange towards said center through said hole of said second end piece and with its bearing portion bearing against said hole of said second piece; and wherein said roll gripping portion of said second core insert secures said second core insert to said roll of flooring material such that said second core insert rotates when flooring material is unwound from said roll.

5. The package of claim 4 wherein said axially extending part of each insert is cylindrical and said flange of each insert is diposed between the associated end piece and the adjacent end of said container.

6. The package of claim 4 wherein said roll gripping portion of said first and said second core inserts each include a plurality of radially outwardly extending barbs for gripping the core of said roll.

7. The package of claim 6 wherein said barbs are slanted away from the center of said roll such that said core inserts may be readily inserted in said core and said barbs will resist removal of the core inserts from said core.

8. The package of claim 5 wherein said holes in said first and said second end pieces include view slots extending radially to said roll axis and said container includes corresponding axially aligned view slots to enable viewing of the amount of flooring material remaining on a roll without opening said container.

9. The package of claim 5 further including dispensing means extending across a front side of the container.

10. The package of claim 9 wherein said dispensing means is an access opening and further including indicia on said front side of said container parallel to said access opening such that the length of textile material dispensed from said roll may be readily determined using said indicia.

11. The package as set forth in claim 10 wherein said dispensing means comprises a flap hinged to said front side.

12. The package of claim 1 further including securing means on said containers for stabilizing like containers stacked one atop the other.

13. The package of claim 12 wherein said securing means comprises tab means in at least one side of said container and slot means in the same side, each said tab means and slot means being disposed opposite each other such that when like containers are stacked one above the other the tab means of one container cooperatively locks into slot means of an adjacent container.

* * * * *

UNITED STATES PATENT AND TRADEMARK OFFICE

CERTIFICATE OF CORRECTION

PATENT NO. : 4,444,313

DATED : April 24, 1984

INVENTOR(S) : TRAVIS C. TYSON

It is certified that error appears in the above-identified patent and that said Letters Patent is hereby corrected as shown below: On the title page the following should be added:

-- [73] Assignee: Lancer Enterprises, Incorporated, Dalton, Georgia --.

Signed and Sealed this

Sixteenth Day of October 1984

[SEAL]

*Attest:*

GERALD J. MOSSINGHOFF

*Attesting Officer*

*Commissioner of Patents and Trademarks*